United States Patent [19]

Back

[11] Patent Number: 4,565,051

[45] Date of Patent: Jan. 21, 1986

[54] METHOD AND APPARATUS FOR WRAPPING CYLINDRICAL ARTICLES

[76] Inventor: Karl J. Back, Hargs Säteri, S-194 90 Upplands-Väsby, Sweden

[21] Appl. No.: 437,521

[22] Filed: Oct. 29, 1982

[30] Foreign Application Priority Data

Nov. 3, 1981 [SE] Sweden ..... 8106503

[51] Int. Cl.[4] ..... B65B 11/04; B65B 11/58; B65B 13/02

[52] U.S. Cl. ..... 53/441; 53/176; 53/211; 53/449; 53/465; 53/556

[58] Field of Search ..... 53/168, 170, 176, 210, 53/211, 214, 215, 216, 399, 441, 449, 465, 556, 587, 588; 100/15; 242/7.22

[56] References Cited

U.S. PATENT DOCUMENTS 1,654,258 4/1927 Hooper ..... 53/176
1,870,399 8/1932 Butler et al. ..... 53/211
3,928,939 12/1975 Edwards et al. ..... 53/449

FOREIGN PATENT DOCUMENTS 2056401 3/1981 United Kingdom ..... 53/556

*Primary Examiner*—Robert L. Spruill
*Assistant Examiner*—Michael D. Folkerts
*Attorney, Agent, or Firm*—Burns, Doane, Swecker & Mathis

[57] ABSTRACT

In wrapping cylindrical goods or articles the article (1) is rotated about its axis, a stretch film (14) being wrapped round the article (1) substantially in a plane containing the axis of the article. A web-like wrapping material (24) is pressed against the cylindrical surface of the article (1) for rolling out on the article by rotation thereof. The stretch film (14) is wound over the material web (24). The stretch film can be one with a smooth and a sticky side, and which is pulled out from a supply (4). Winding the stretch film can be interrupted when the supply (4) is opposite one end surface of the article while the article rotation is continued a half turn, whereby the stretch film is laterally reversed in relation to the article. The film (14) can be initially wound with its smooth side in contact with the article (1) and later easily laterally reversed so that its smooth side is turned outwards to form the exterior of the article wrapping.

8 Claims, 2 Drawing Figures

METHOD AND APPARATUS FOR WRAPPING CYLINDRICAL ARTICLES

TECHNICAL FIELD

Figure 1:
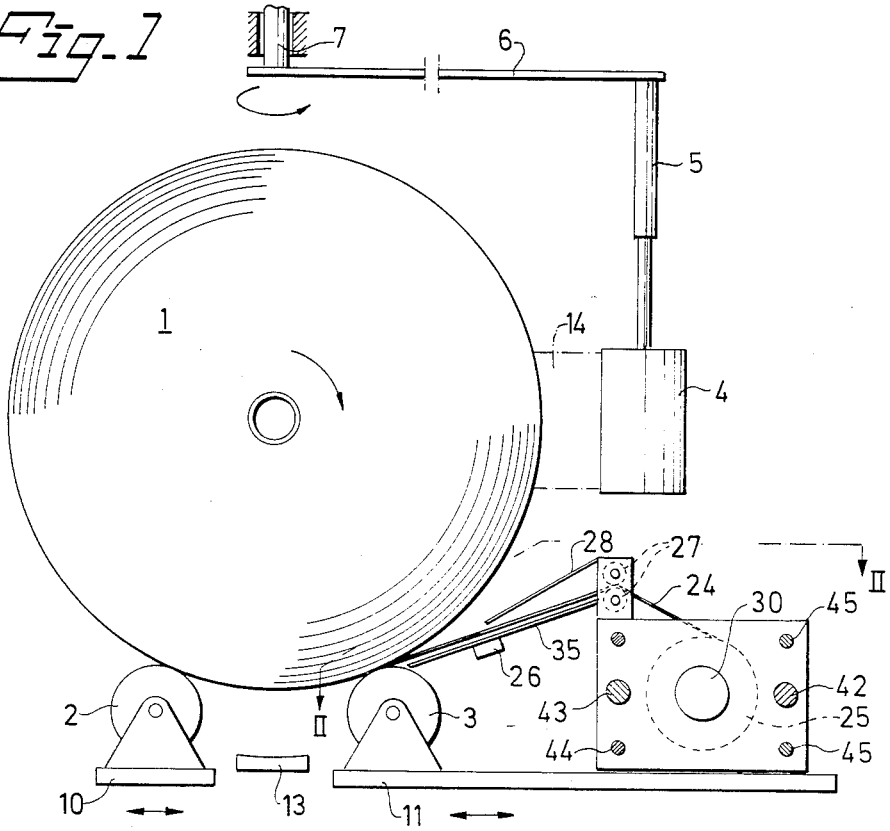

The invention relates to a method of wrapping cylindrical goods or articles in a wrapping station, the article being rotated about its axis and a strech film wound around the article substantially in a plane through the axis thereof. The invention also relates to an apparatus for carrying out the method, said apparatus including means for rotating the article about its axis and means for winding stretch film round the article substantially in a plane containing the article axis.

BACKGROUND

Cylindrical goods or articles, e.g. the paper rolls delivered from a paper machine, can to advantage be wrapped with stretch film by the article being carried on a pair of parallel, horizontal, rotatable rolls of which at least one is driven for rotation, a store of stretch film being orbited round the article in a horizontal plane through the article axis, stretch film being wound on while the article is rotated on the rolls.

It is thereby intended that the wrapping will be impervious and durable.

It has however been found that stretch film wrapping has a tendency to be damaged, especially at the cylindrical surface of the article during subsequent handling of the article when wrapped.

A film which is smooth on one side and sticky on the other, is utilized to advantage as stretch film. Such film is primarily utilized to provide a smooth outer surface on the wrapping, which is essential, since after wrapping the the article is moved relative a contact surface; the wrapping would thus be torn due to friction against the contact surface if the wrapping did not have a smooth outer surface. The "sticky" surface of the film serves to provide a certain amount of adhesion between the turns of film. However, the film must then be wound with its sticky side towards the article, resulting in a risk of the film sticking to, and spoiling the surface of the article and also that the article surface must be cleaned from sticking film residue.

A stretch film such as is smooth on one side and sticky on the other has relatively low adhesion for contact between the sticky and smooth surfaces thereof, but the adhesion will be very strong when sticky surface is brought into contact with sticky surface.

OBJECT

One object of the invention is to provide improved strength and imperviousness for a wrapping of the kind in question. A further object is effectively to utilize a stretch film, which is smooth on one side and sticky on the other for such wrapping, and where sticky contact between film and goods can be avoided.

CHARACTERIZATION OF THE INVENTION

The invention is based on the technique of wrapping cylindrical articles in a wrapping station, the article being rotated about its axis and a stretch film wound round the article substantially in a plane containing the article axis, and in essentials the invention is distinguished by a web-like wrapping material being placed against the curved surface of the article for reeling out on the curved surface thereof as the article is rotated, the stretch film being wound over the material web. To advantage, the stretch film is smooth on one side and sticky on the other. The stretch film is suitably wound with its smooth surface towards the article. The web-like wrapping material can then be laid against the stretch film, which has been placed on the article by winding. The material will then be able to adhere to the sticky surface of the stretch film and thus be caused to accompany it as well as be retained on the article. When the material web, as it is advanced, passes the winding plane, the web is wound over by the stretch film. In the preferred embodiment, said material web also comprises stretch film which to advantage can be sticky on one side and smooth on the other, the sticky side then being arranged to advantage facing the article. The stretch film wound round the article in the axis plane is to advantage arranged as a supply in the form of a roll arranged to orbit round the article. In order to ensure that the wrapping obtains a smooth outer surface the stretch film can be reversed, e.g. by the orbiting of thestretch film supply being interrupted when the supply is in front of one of the end surfaces of the article, while rotating the article continues for a half turn so that the stretch film is reversed with relation to the article, subsequent to which the supply can once again circle round the article, but in the opposite direction.

The material web rolled onto the cylindrical surface of the article is suitably delivered from a supply, e.g. a roll of material which is displaceable parallel to the axis of the article, winding of the material web onto the article being given the desired pitch by controlled axial displacement of the supply.

However, it should be noted that the width of the material web can very well be adjusted to the length of the article so that the material web will entirely cover the curved surface of the article (so called full web). It should also be understood that said material web does not necessarily need to consist of stretch film but may also consist of paper, carton or even corner reinforcing material, said material being or having been creased to an L-shape for protecting the end edges of the article.

The material web can be delivered from the supply through the nip between two rolls, of which preferably at least one is driven for delivering the material web from the supply. A guide plate is further arranged to extend from the roll pair to a position at the junction with the curved surface of the article, so that the material web is delivered into contact with said surface (or on the stretch film wound onto the curved surface of the article). The article is carried for rotation about its axis by a pair of parallel rolls, of which at least one is driven for rotation. The material web supply, driving and guiding rolls for the material web and the guide plate are thereby adapted for directing the material web in towards the nip between the article and one of the rolls carrying the article so that the material web is pressed against the article in said nip.

The supply may be displaceable in the axial direction of the article by means of a rotatable screw coacting with a nut in association with the supply so that the supply is displaced by driving rotation of the screw.

It should however be clear that the material web and its web delivering means can be adapted to direct the material web to the opposite side of the article from that shown in FIG. 1, so as to engage the article just below the plane defined by the lower edge of the orbiting stretch film.

The inventive wrapping apparatus includes means for rotating the article about its axis and means for winding the stretch film about the article substantially in a plane containing the axis of the article, and is substantially distinguished by means for carrying a supply of a material web in the vicinity of the curved surface of the article carried by the rotating means, and means for applying the end of the material web to the curved surface of the article.

Means for cutting the material web can be arranged in conjunction with the application means. The winding or wrapping means can be arranged for being kept still in a position in front of one end of the article while the rotating means rotates the article a half turn to allow reversing the stretch film, i.e. turning its other side towards the article. The supply carrying means and the application means are preferably displaceable along the rotating means so that the material web can be helically wound onto the curved surface of the article.

The invention is defined in the appended patent claims.

The invention will now be described in detail with the aid of an example and with reference to the appended drawing.

DRAWING

Figure 2:
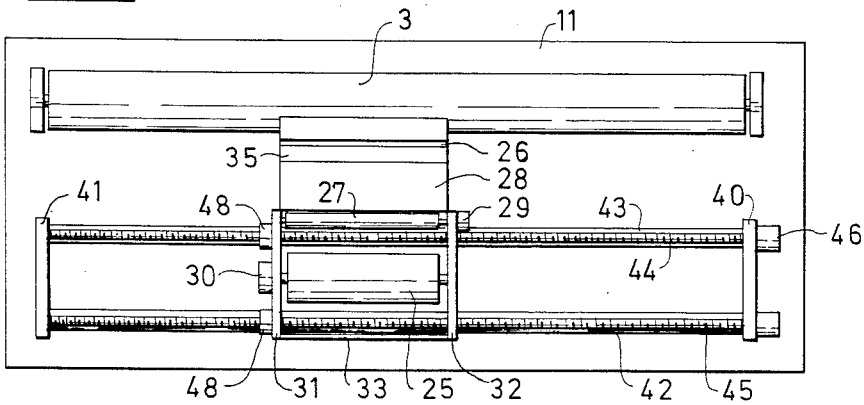

FIG. 1 schematically illustrates an end view of an apparatus in accordance with the invention. FIG. 2 is a view taken along the line II—II in FIG. 1.

EMBODIMENT

On FIG. 1 there is shown an article or a roll 1, carried by two rotatable, parallel, horizontal rolls 2,3, of which at least one is driven for rotation so that the article 1 rotates about its axis in the direction indicated by the arrow. Furthermore, a stretch film supply 4 is carried at the level of the article axis by means of an arm arrangement 5,6 mounted at a vertical shaft 7 disposed in a vertical plane between the rolls 2,3 and approximately at half the length thereof. The arm arrangement 5,6 can orbit about the axis 7 by means of a motor (not shown). The rolls 2,3 are respectively carried on a slide or carriage 10,11, each of which is displaceable in the horizontal plane for enabling lifting up the article 1 and lowering it onto a substructure 13, e.g. in the form of a linear conveyor, between the rolls 2,3.

The supply 4 can be raised or lowered by the arm arrangement, the vertical portion 5 of which is telescopic. A stretch film web 14 is pulled out from the supply 4 and attached to the article 1. The supply 4 is orbited round the article 1 in a horizontal plane through the article axis 1 by rotation about the journalling shaft 7. Simultaneously the article 1 is rotated on the rolls 2,3 so that the stretch film web 14 is caused to cover the surface of the article 1 with overlapping edges.

A material web 24 is pulled out from a material web roll 25 by means of a pair of delivery rolls 27, of which at least one is driven for rotation. The tongue or delivery end of the material web 24 runs over a guide plate 35 containing a cutting means 26, which may comprise a heated wire in the case where the material web 24 is stretch film. An upper guide plate 28 may also possibly be arranged substantially parallel to the plate 35 to define a delivery slit for the material web 24. The plate 35 is directed towards the bite between the article 1 and roll 3.

The stretch film 14 is preferably of the type which is sticky on one surface and smooth on the other, the supply 4, which may include a cage containing a rotatably mounted roll of stretch film material, is adapted to apply the stretch film 14 with its smooth side facing towards the article 1. The stretch film 14 is thus applied such that its smooth surface is brought into contact with the surface of the article 1. When the film 14 has been applied to the article while it rotates a quarter of a revolution, the material web 24 is fed out into contact with the stretch film layer on the surface of the article 1, the material web 24 adhering to the sticky surface of the stretch film 14. The wrapping operation is continued during simultaneous winding-on of stretch film 14 and material web 24 so that the whole of the circular surface of the article 1 is covered by the material web 24, the latter then being separated with the aid of the cutting means 26 and rotation of the rolls 27 broken off.

The supply 4 may subsequently be brought into a position directly opposite one end surface of the article 1 and be stopped there, while the rolls 2,3 are caused to rotate the article 1 a further half turn. This means that the stretch film web 14 is reversed, so that its sticky surface faces towards the article 1. Subsequent hereto, orbiting of the supply 4 about the article is taken up once again so that the stretch film 14 is applied the whole way round the article 1. The article wrapped thus then has a smooth surface. The film web 14 can subsequently be cut off and the wrapped article 1 can be removed from the apparatus, e.g. by moving the slides 10,11 apart so that the wrapped article 1 is set down onto the conveyor 13 for taking away.

By means of the above-described technique, the article surface will come into direct contact with the smooth surface of the film 14, the wrapping thereby exteriorly having a layer of stretch film 14 outwardly having a smooth surface.

If the material web 24 comprises one-sided sticky stretch film, at least one layer of the stretch film 24 and one of the stretch film 14 will meet with sticky surfaces towards each other so that the wrapping casing round the article 1 will be firmly grid-reinforced, which is of particular importance, since stretch film has a tendency to tear easily in its stretch direction. Furthermore, two layers in the wrapping will meet with smooth surfaces towards each other, which means that an application of force towards the article may cause gliding between these two smooth layer surfaces. The latter situation means that an exterior application of force can be taken up by the wrapping elasticity without causing tearing damage to the wrapping.

It should be clear that the material web 24 does not necessarily need to comprise stretch film, but can also comprise paper, paper-board or the like. Furthermore, it should be clear that the material web 24 may comprise a strip adapted for placing over the edges of the cylindrical article 1, the material web to advantage being creased to an L-profile before applying to the corners of the article 1.

In FIG. 2 it is illustrated how the material roll 25 is carried for rotation restricted by a brake 30, so that the material web 24 is given the desired tension. The roll 25 is mounted for rotation in a cage formed by parallel end plates 31,32 connected by means of spacer rods 33 (of which only one is illustrated). The delivery rolls 27 are carried by the plates 31,32, the plates 35,28 being also carried by the plates 31,32. Roll 27 is driven by a controllable motor 29.

The plates 31,32 furthermore having gliding guides for the rails 44,45, as well as nuts 48 for screws 42,43, which are mounted for rotation by means of a motor 46. The rails 42,43 and screws 44,45 are mounted in end plates 40,41 which are rigidly mounted to either end of the slide 11. By rotation of the screws 42,43 the carriage formed by the plates 31,32 is displaced along the slide 11. This means that the material web 24 can be wound helically with overlap on the cylindrical surface of the article 1.

It should however be clear that the especial embodiment indicated in FIG. 2 can very easily be dispensed with, in respect of axial displaceability of the material web roll 25, and instead have a stationarily mounted material web roll 25, the width of which coincides with, or exceedes the length of the article 1. It should also be clear that lateral reversal of the film can be done alternatively by turning the supply 4 180° vertically in the vertical plane, but the lateral reversal technique described above for the film is to be preferred.

I claim:

1. A method of wrapping a cylindrical article at a wrapping station, including rotating the article about an axis of the article and winding a stretch film round the article substantially in the axis plane of the article, the improvement comprising; placing a web-like wrapping material against a surface of the cylindrical article for rolling out the wrapping material against the cylindrical article by rotation of the cylindrical article and by simultaneously winding the stretch film over the material web on the cyclindrical article; interrupting winding of the stretch film at a predetermined position; continuing rotation of the article so that the stretch film is laterally reversed; and, winding the film in the opposite winding direction.

2. Method as claimed in claim 1, wherein the material web is delivered from a supply displaceable parallel to the axis of the article so that the winding pitch of the material web on the article may be given a desired pitch.

3. A method of wrapping a cylindrical article at a wrapping station, including rotating the article about an axis of the article and winding a stretch film round the article substantially in the axis plane of the article, the improvement comprising placing a web-like wrapping material against a surface of the cylindrical article for rolling out the wrapping material against the cylindrical article by rotation of the cylindrical article and by winding the stretch film over the material web on the cylindrical article, providing the stretch film with a smooth side and a sticky side and drawing the film from a supply, interrupting winding of the stretch film when the supply is in front of one end surface of the article while continuing rotation of the article a half turn so that the stretch film is laterally reversed in relation to the article and continuing winding the film in the opposite winding direction.

4. Method as claimed in claim 3, wherein the material web is delivered from a supply displaceable parallel to the axis of the article so that the winding pitch of the material web on the article may be given a desired pitch.

5. An apparatus for wrapping a cylindrical article defining a curved surface including means for rotating the article about an axis of the article and means for winding stretch film about the article substantially in the axis plane of the article, the improvement comprising means for carrying a supply of a material web, said means positioned adjacent the surface of the article carried by the rotating means, and means for applying an end of the material web on the curved surface of the article; said means for winding the stretch film movable to a predetermined stationary position; and wherein said means for rotating the article reverses the stretch film so as to permit winding the stretch film in an opposite winding direction.

6. Apparatus as claimed in claim 5, wherein the winding means is adapted for remaining stationary in a position opposite one end surface of the article while the rotating means rotates the article a half turn for allowing lateral reversal of the stretch film relative the article so as to permit the winding means to wind the film in the opposite winding direction after said reversal.

7. Apparatus as claimed in claim 6, wherein the means for carrying the material web supply and the applying means are displaceable along the rotating means.

8. Apparatus as claimed in claim 5, wherein the means for carrying the material web supply and the applying means are displaceable along the rotating means.

* * * * *